US011905065B2

(12) United States Patent
Chupak et al.

(10) Patent No.: US 11,905,065 B2
(45) Date of Patent: Feb. 20, 2024

(54) METHOD AND APPARATUS FOR PRODUCING A ROLLED CURL ON AN OPEN END OF METAL CONTAINER

(71) Applicant: Exal Corporation, Youngstown, OH (US)

(72) Inventors: Thomas James Chupak, West Middlesex, PA (US); Keith Osborne Mitchell, Fredonia, PA (US)

(73) Assignee: Exal Corporation, Youngstown, OH (US)

( * ) Notice: Subject to any disclaimer, the term of this patent is extended or adjusted under 35 U.S.C. 154(b) by 0 days.

(21) Appl. No.: 15/482,261

(22) Filed: Apr. 7, 2017

(65) Prior Publication Data

US 2017/0333970 A1 Nov. 23, 2017

Related U.S. Application Data

(60) Provisional application No. 62/320,401, filed on Apr. 8, 2016.

(51) Int. Cl.
*B65D 1/02* (2006.01)
*B65D 41/40* (2006.01)
(Continued)

(52) U.S. Cl.
CPC ..... *B65D 1/023* (2013.01); *B65D 41/40* (2013.01); *B21D 19/12* (2013.01); *B21D 51/10* (2013.01);
(Continued)

(58) Field of Classification Search
CPC ..... B65D 1/023; B65D 41/40; B65D 41/405; B65D 41/42; B65D 41/425; B65D 41/44; B65D 41/445
See application file for complete search history.

(56) References Cited

U.S. PATENT DOCUMENTS 2,339,763 A * 1/1944 Calleson ..... B65D 7/00 220/604
2,384,810 A * 9/1945 Calleson ..... B65D 7/04 220/62
(Continued)

FOREIGN PATENT DOCUMENTS

DE 19718014 11/1998
EP 1167222 1/2002
(Continued)

OTHER PUBLICATIONS

Mohan, Anne Marie, Aluminum Bottle Bound for Mainstream Beverage Use, Packaging World, Oct. 5, 2009, pp. 1-4, Published on the Packaging World Web site.
(Continued)

*Primary Examiner* — John K Fristoe, Jr.
*Assistant Examiner* — Jennifer Castriotta
(74) *Attorney, Agent, or Firm* — Paul D. Bangor, Jr.; Clark Hill PLC

(57) ABSTRACT

A method for forming a curl on an open end of a metal container, for adapting the metal bottle to be closed by a cap, comprising in sequence: inserting the open end of the metal container into a powered first curler roller housing, wherein the first curler roller housing houses a set of first curler rollers, to deform the open end by turning it outwardly so as to obtain a first stage curl; inserting the open end of the metal container having the first stage curl into a powered second curler roller housing, wherein the second curler roller housing houses a set of second curler rollers, to further deform the open end and first stage curl by turning them outwardly and/or curling them so as to obtain a second stage curl; inserting the open end of the metal container or bottle having the second stage curl into a powered third curler roller housing, wherein the third curler roller housing houses a set of third curler rollers, to further deform the open end and
(Continued)

second stage curl by turning them outwardly, curling them and/or compressing the second stage curl radially and/or longitudinally downward towards a bottom of the metal container so as to obtain a third stage curl.

1 Claim, 10 Drawing Sheets

(51) Int. Cl.

| | |
|---|---|
| *B21D 51/26* | (2006.01) |
| *B21D 19/12* | (2006.01) |
| *B21D 51/10* | (2006.01) |
| *B21D 51/32* | (2006.01) |

(52) U.S. Cl.
CPC ..... *B21D 51/2623* (2013.01); *B21D 51/2661* (2013.01); *B21D 51/32* (2013.01)

(56) References Cited

U.S. PATENT DOCUMENTS

| | | | | |
|---|---|---|---|---|
| 3,818,850 | A * | 6/1974 | Berthet | B21D 19/12 72/348 |
| 4,055,266 | A * | 10/1977 | Amabili | B65D 41/42 215/252 |
| 4,313,545 | A * | 2/1982 | Maeda | B65D 7/04 220/4.04 |
| 4,435,969 | A | 3/1984 | Nichols et al. | |
| 5,065,888 | A * | 11/1991 | Gallagher | B21D 51/26 220/669 |
| 5,086,944 | A | 2/1992 | Duffy et al. | |
| 5,718,352 | A * | 2/1998 | Diekhoff | B21D 51/26 215/44 |
| 7,497,350 | B2 | 3/2009 | Enoki et al. | |
| 7,578,158 | B2 | 8/2009 | Frattini | |
| 8,020,420 | B2 | 9/2011 | Frattini | |
| 8,066,115 | B2 | 11/2011 | Frattini | |
| 8,286,460 | B2 | 10/2012 | Frattini | |
| 8,590,358 | B2 | 11/2013 | Frattini et al. | |
| 8,899,091 | B2 | 12/2014 | Ramsey et al. | |
| 9,139,324 | B1 | 9/2015 | Watkins et al. | |
| 9,248,943 | B2 | 2/2016 | Raw et al. | |
| 10,220,983 | B1 * | 3/2019 | Gilliam | B65D 23/0821 |
| 2007/0181526 | A1 * | 8/2007 | Frishman | B65D 47/36 215/257 |
| 2008/0253862 | A1 | 10/2008 | Gillest | |
| 2012/0024813 | A1 * | 2/2012 | Nakagawa | B65D 1/0246 215/40 |

FOREIGN PATENT DOCUMENTS

| | | |
|---|---|---|
| GB | 548274 | 10/1942 |
| JP | H07256375 | 10/1995 |
| WO | 2007124792 | 11/2007 |

OTHER PUBLICATIONS

Form PCT/ISA/220, PCT Notification of Transmittal of the International Search Report and the Written Opinion of the International Searching Authority, or the Declaration, PCT/US2017/026632, dated Jul. 26, 2017.

Form PCT/ISA/210, PCT International Search Report for International Application No. PCT/US2017/026632, dated Jul. 26, 2017.

Form PCT/ISA/237, PCT Written Opinion of the International Searching Authority for International Application No. PCT/US2017/026632, dated Jul. 26, 2017.

* cited by examiner

METHOD AND APPARATUS FOR PRODUCING A ROLLED CURL ON AN OPEN END OF METAL CONTAINER

CROSS REFERENCE TO RELATED APPLICATIONS

This application claims the benefit of the filing date of U.S. provisional patent application Ser. No. 62/320,401, filed on Apr. 8, 2016, the entirety of which is incorporated herein by reference for all purposes.

BACKGROUND

The present disclosure refers to a method and related apparatus to make a rolled curl, i.e., an edge or a collar, on which to secure a sealing cap on the open ends of drawn and wall ironed extruded, reverse drawn and wall ironed (DWI), deep-drawn and deep-drawn/wire-drawn metal containers.

More particularly, the present disclosure refers to a process and apparatus to make a rolled curl on the open end of DWI 3000 series alloy aluminum bottles produced on a Coil-to-Can (C2C) line.

Metal containers that are subject to the process of the present disclosure are especially, but not exclusively, those made of aluminum, its alloys, steel or other suitable materials from which bottles for the beverage and food sectors or for technical use are made.

The basic shape of these metal containers is basically cylindrical. Prior to applying the process of the present disclosure such containers are shaped according to known procedures and technologies such as the tapering process of the upper end of such metal bodies or containers on rotary or indexing forming or necking machines engineered to handle the less-malleable materials used for DWI cans/bottles, typically made of 3104 aluminum alloy that is lighter but stronger and harder (thus more difficult to shape) than the 1070 aluminum alloy used for impact extrusion.

Producing a rolled curl on the open ends of aluminum bottles of a series 3000 aluminum alloy coil feedstock presents certain obstacles due to the increased hardness and stiffness of the series 3000 aluminum alloy material. The solution to these obstacles is embodied in the method and apparatus of the present disclosure.

SUMMARY

One aspect of a preferred embodiment of the present disclosure comprises a method for forming a curl on an open end of a metal container, for adapting the metal bottle to be closed by a cap, comprising in sequence: inserting the open end of the metal container into a powered first curler roller housing, wherein the first curler roller housing houses a set of first curler rollers, to deform the open end by turning it outwardly so as to obtain a first stage curl; inserting the open end of the metal container having the first stage curl into a powered second curler roller housing, wherein the second curler roller housing houses a set of second curler rollers, to further deform the open end and first stage curl by turning them outwardly and/or curling them so as to obtain a second stage curl; inserting the open end of the metal container or bottle having the second stage curl into a powered third curler roller housing, wherein the third curler roller housing houses a set of third curler rollers, to further deform the open end and second stage curl by turning them outwardly, curling them and/or compressing the second stage curl radially and/or longitudinally downward towards a bottom of the metal container so as to obtain a third stage curl.

In another aspect of a preferred method of the present disclosure, the third stage curl is the finished curl.

In a further aspect of a preferred method of the present disclosure, the third curler roller housing is identical to the second curler roller housing.

In another aspect of a preferred method of the present disclosure, the set of second curler rollers is identical to the set of third curler rollers.

In yet another aspect of a preferred method of the present disclosure, the first curler roller housing is larger than both of the second and third curler roller housings.

Another aspect of a preferred embodiment of the present disclosure comprises a metal bottle defining an opening and a rolled curl around the opening, wherein the rolled curl has a leading edge having a substantially vertical portion.

In another aspect of a preferred metal bottle of the present disclosure, the substantially vertical portion extends into a space defined by the rolled curl.

In a further aspect of a preferred metal bottle of the present disclosure, an outside surface of the leading edge engages an outer surface of the metal bottle.

In another aspect of a preferred metal bottle of the present disclosure, a portion of the rolled curl defines a curve having a radius of 1.4 mm.

In another aspect of a preferred metal bottle of the present disclosure, the rolled curl defines an outer edge having a substantially flat surface wherein an angle between a line lying in a plane of the substantially flat surface and a longitudinal centerline of the metal bottle ranges from about 8° to about 12°.

In an additional aspect of a preferred metal bottle of the present disclosure, the angle is 10°.

Yet another aspect of a preferred embodiment of the present disclosure comprises a curler roller for curling an open end of a metal container or bottle, wherein the curler roller defines a working surface comprising a portion having a curve with a radius of about 1.5 mm.

In another aspect of a preferred curler roller of the present disclosure, the curler roller defines a second working surface at about a 10° angle to the portion having the curve with the radius of about 1.5 mm.

DETAILED DESCRIPTION

Figure 1:
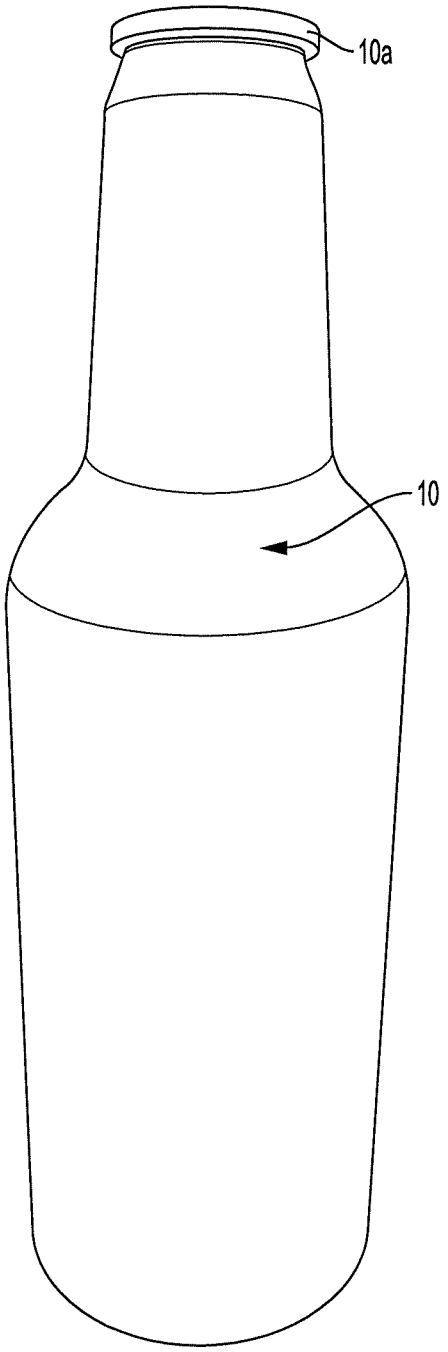
FIG. 1 is a perspective view of a preferred embodiment of a metal container or metal bottle of the present disclosure.

It should, of course, be understood that the description and drawings herein are merely illustrative and that various modifications and changes can be made in the structures disclosed without departing from the present disclosure. In the drawings hereof, like numerals refer to like parts throughout the several views.

The process to make an edge or a collar according to this present disclosure includes a plurality of subsequent working stages as specified hereinafter.

Figure 2:
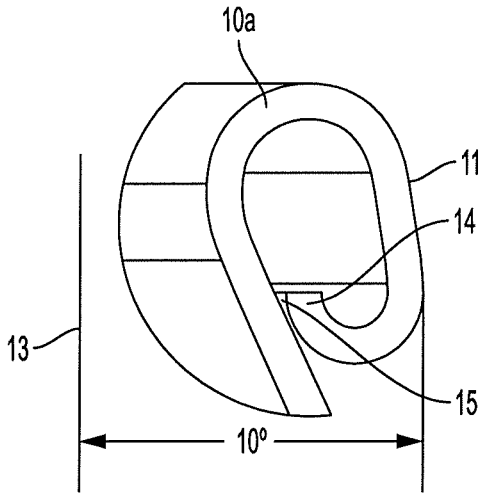
FIG. 2 is a schematic view of a preferred embodiment of a collar of a preferred embodiment of a metal container or metal bottle of the present disclosure.

FIG. 1 of the drawings illustrates a metal container referenced with 10, whose side surface has already undergone the deformation stage to achieve the beverage bottle shape and whose upper end has already undergone the process stages according to the present disclosure to obtain an edge or collar 10*a*, as shown in cross-section in FIG. 2.

Figure 3:
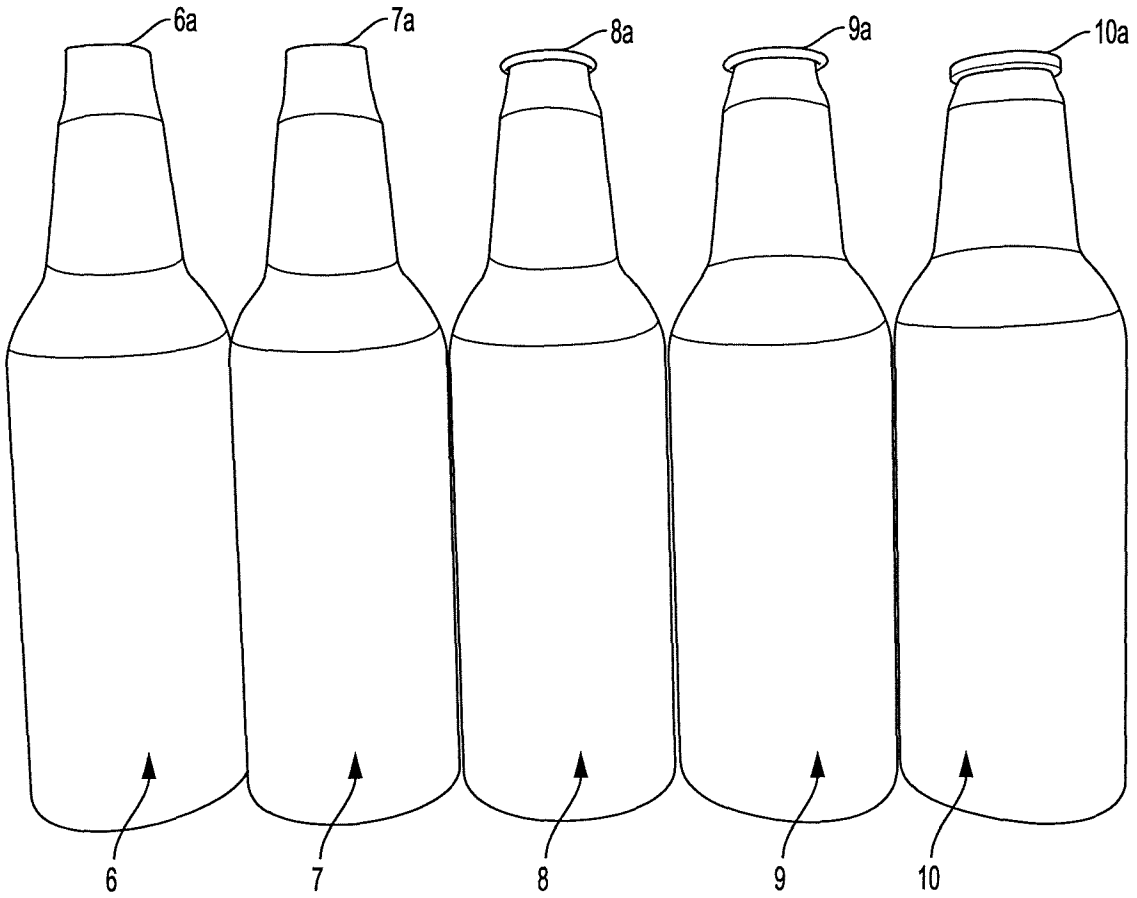
FIG. 3 is a perspective view of a series metal containers worked on and/or produced by a preferred method of the present disclosure including a preferred embodiment of a metal container or metal bottle of the present disclosure.
Figure 4:
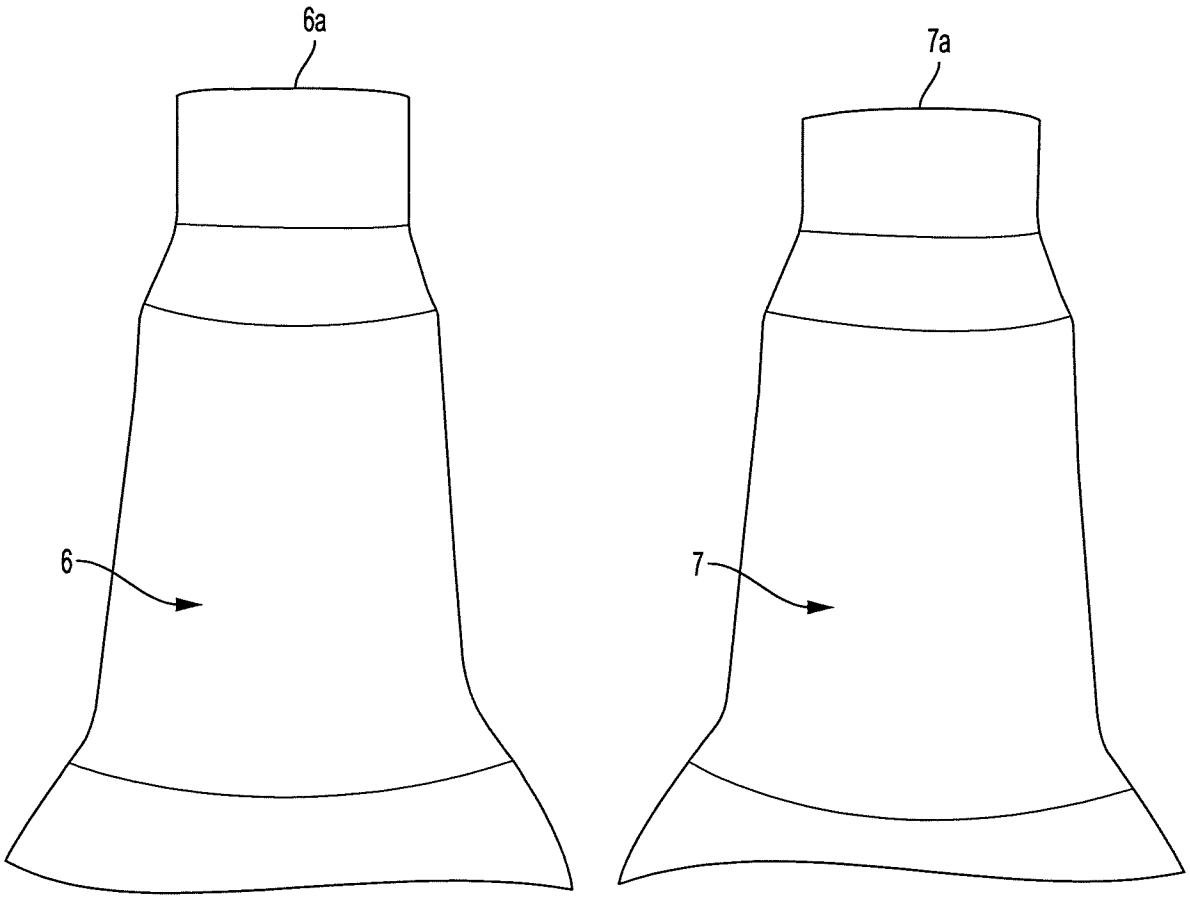
FIG. 4 is a perspective view of a series metal containers worked on and/or produced by a preferred method of the present disclosure.
Figure 5:
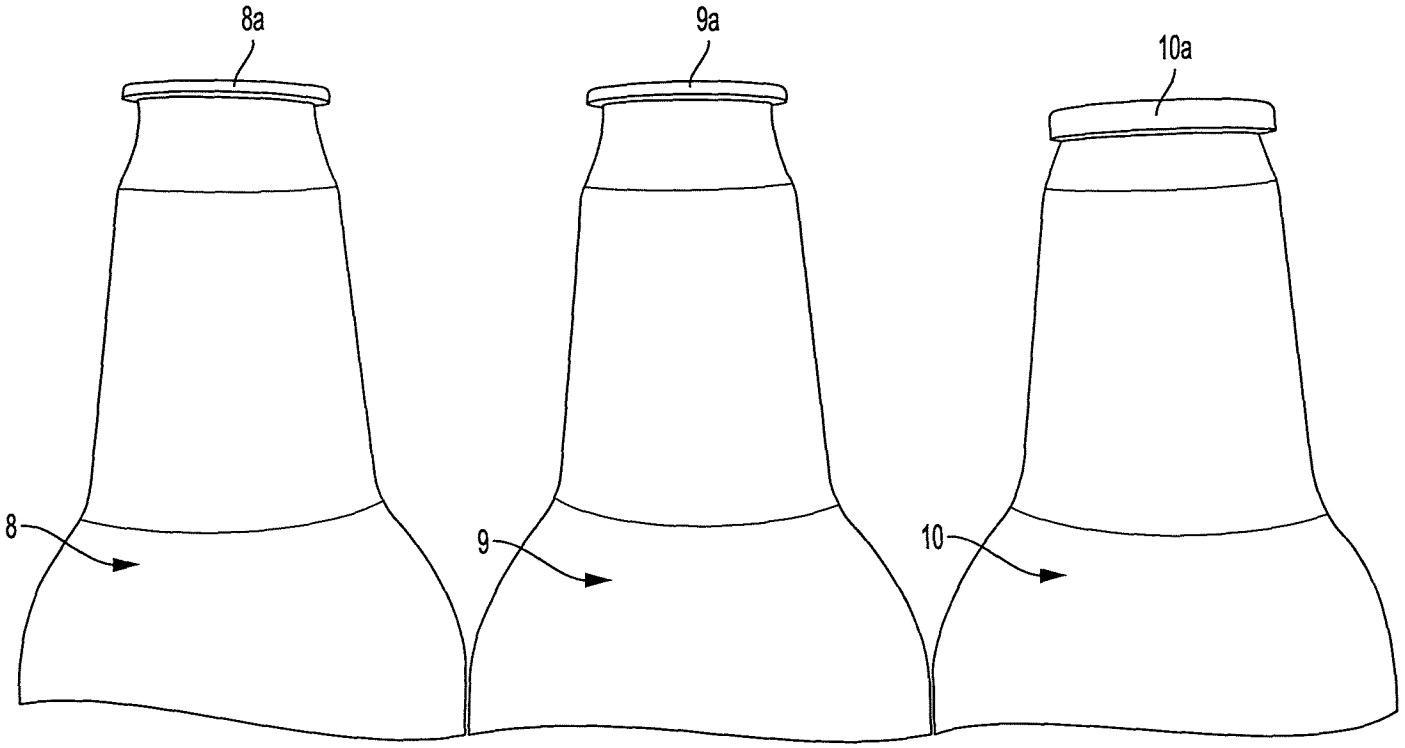
FIG. 5 is a perspective view of a series metal containers worked on and/or produced by a preferred method of the present disclosure including a preferred embodiment of a metal container or metal bottle of the present disclosure.

FIGS. 3-5 illustrate a series of intermediate metal containers 8-9 produced according to the method and apparatus of the present disclosure prior to producing the end product metal bottle 10 which has rolled curl 10*a* fit to receive a crown closing cap. A preferred method of the present disclosure for producing metal bottle 10 having rolled curl 10*a* is shown schematically in FIGS. 6*a*-6*d* with preferred apparatus for producing the same shown in FIGS. 7-10.

As shown in FIG. 3, precursor metal containers 6 and 7 have no curl on their open ends 6*a* and 7*a*, respectively. Metal container 6 typically represents a metal container coming off the last station of a forming or necking machine as is known in the art. Preferably, the apparatus of the present disclosure may be incorporated into such a forming or necking machine or provided as part of a separate forming machine down the line therefrom.

Figure 6A:
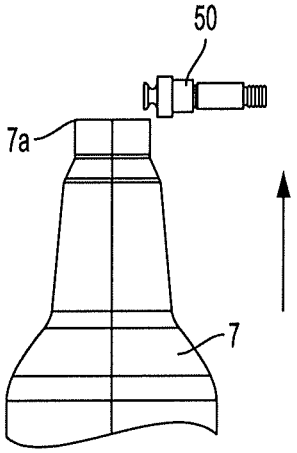
FIGS. 6*a*, 6*b*, 6*c* and 6*d* provide schematic views of a preferred method of the present disclosure for producing the a preferred metal container or metal bottle of the present invention having a rolled curl fit to receive a crown closing cap.
Figure 6B:
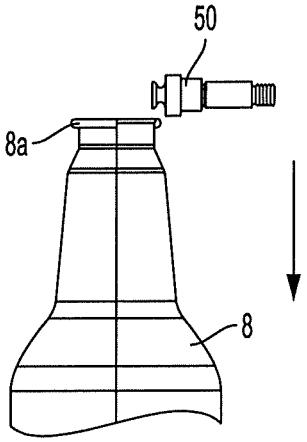

Preferably, the sequencing of the method of the present disclosure for producing metal container 10 with rolled curl 10*a*, begins with metal container 7 (produced via final trimming of metal container 6) being inserted into curler roller housing 30 (such as in may be installed on a forming or necking machine) which houses curler rollers 50 as shown in FIGS. 6*a*-6*b*, and 7-9. FIG. 6*a* shows metal container 7 being inserted in curler roller housing 30 towards curler rollers 50 which acts upon open end 7*a* of metal container 7 thereby producing metal container 8 having open end with curl 8*a* (O.D. of curl 8*a* is about 25.28 mm) as shown in FIG. 6*b*. Preferably the reduction in height of the top of the metal containers from 7 to 8 is about 3 mm, with metal container 8 being about 3 mm shorter than metal container 7 as shown in FIGS. 6*a*-6*b*.

Figure 6C:
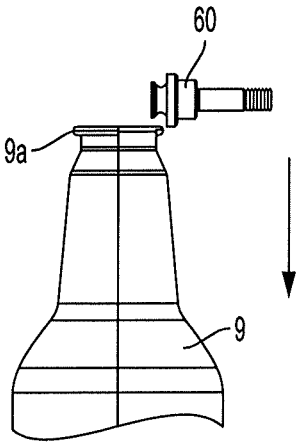

Curler roller housing 40*a* housing curler rollers 60 (FIG. 10) would then be applied with force onto precursor metal container 8 to form precursor metal container 9 having rolled curl 9*a* (O.D. of curl 9*a* is about 26.12 mm) as shown in FIG. 6*c*. Preferably the reduction in height of the top of the metal containers from 8 to 9 is about 1.5 mm, with metal container 9 being about 1.5 mm shorter than metal container 8 as shown in FIGS. 6*b*-6*c*.

Figure 6D:
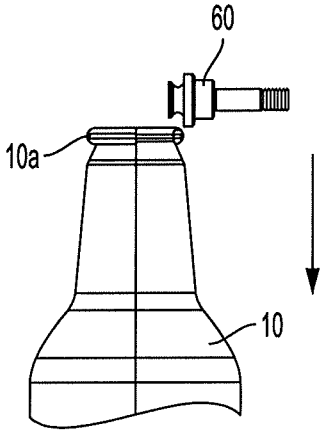
Figure 7:
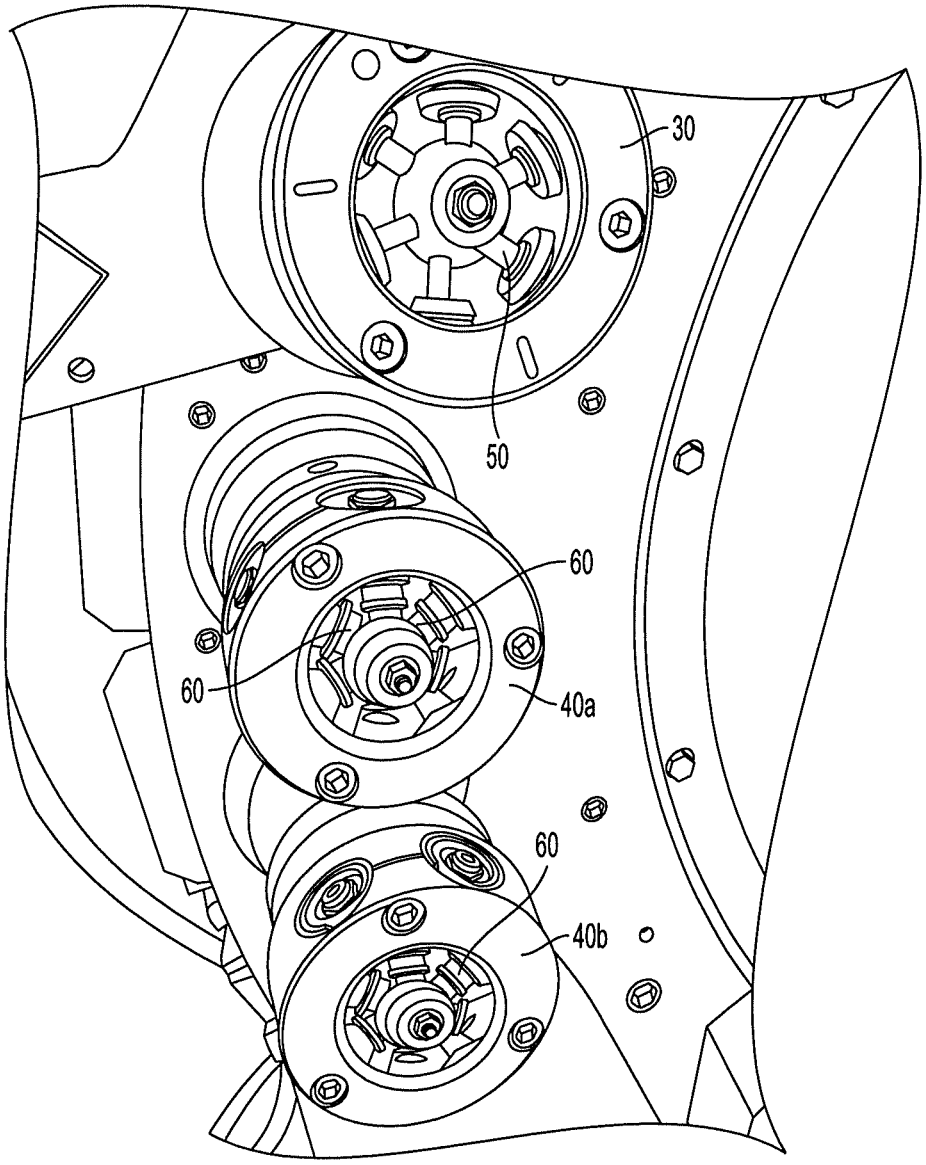
FIG. 7 is a perspective view of preferred curler roller housings and curler rollers used in a preferred method of the present disclosure for producing a preferred embodiment of a metal container or metal bottle of the present disclosure having a rolled curl fit to receive a crown closing cap.

Curler roller housing 40*b*, preferably identical to curler roller housing 40*a* housing curler rollers 60 (FIG. 10), would then be applied with force onto precursor metal container 9 to form metal container 10 having finished curl 10*a* (O.D. of curl 10*a* is about 26.6 mm) as shown in FIG. 6*d*. Preferably the reduction in height of the top of the metal containers from 9 to 10 is about 3 mm, with metal container 10 being about 3 mm shorter than metal container 9 as shown in FIGS. 6*c*-6*d*.

Preferably, curler roller housings 40*a* and 40*b* may be installed on a forming or necking machine in sequence after curler roller housing 30. Also, the amount of height reduction in the metal container may be controlled by the relative distance the metal container is fed into the curler roller housing 30 and 40*a*, 40*b*. Preferably, metal container 8 is fed into curler roller housing 40*a* so that curl 8*a* only partially fills voids 61 in curler rollers 60 to produce curl 9*a* on metal container 9. In the next step, metal container 9 is fed into curler roller housing 40*b* so that curl 9*a* completely or nearly completely fills voids 61 in curler rollers 60 to produce curl 10*a* on metal container 10.

Preferably the upper end of the metal container 10 is approximately ranges between 0.1 and 1 mm, preferably between 0.3 and 0.5 mm, in thickness.

The process of the present disclosure, in its preferential embodiment, includes a starting operating stage during which the upper end portion of metal container 7 is initially cylindrical, as depicted in FIGS. 3-5, is folded back or turned outwardly by an angle of at least 270 degrees so as to obtain intermediate collars 8*a* on metal container 8 and 9*a* on metal container 9 with a basically circular section. In the operation depicted schematically in FIG. 6*d*, intermediate curl 9*a* on metal container 9 is deformed by curler rollers 60 in curler roller housing 40*b* in the radial direction, towards the axis of the metal container 9, and is simultaneous stretched towards the bottom of the metal container 9. The curl 10*a* thus obtained is more ellipsoidal or even ovoidal in cross-section as best illustrated in FIG. 2. Also, leading edge 14 of curl 10*a* is preferably tucked inside of curl 10*a* and is substantially vertical in orientation. It has been found that the interaction between the outside surface 15 of leading edge 14 and the outside of metal container 10 (see FIG. 2) is important to and helps provide the rigidity and strength of curl 10*a* necessary for having a cap applied thereto and for retaining a strong seal between such cap and curl 10*a*. Also, the angle between the outside surface 11 of curl 10*a* and centerline 13 of metal container 10 is preferably between 8°-12° and more preferably about 10°, i.e., the same 10° as defined by shoulder 62 of curler roller 60 which helps define void 61 thereof.

The outer diameter of the open end of metal container 10 to the outer surface of curl 10*a* ranges between 25 and 28 mm and preferably between 26 and 27 mm whereas the inner diameter ranges between 19 and 22 mm, and preferably between 20 and 21 mm. The curl 10*a* preferably has a height, ranging between 2.5 and 5 mm, and preferably between 3 and 4 mm and most preferably 3.85 mm; such height is calculated with reference to the distance between the plane that defines the opening of the metal container 10 and the imaginary plane tangent to the bottom of curl 10*a* as shown in FIG. 2.

Figure 8:
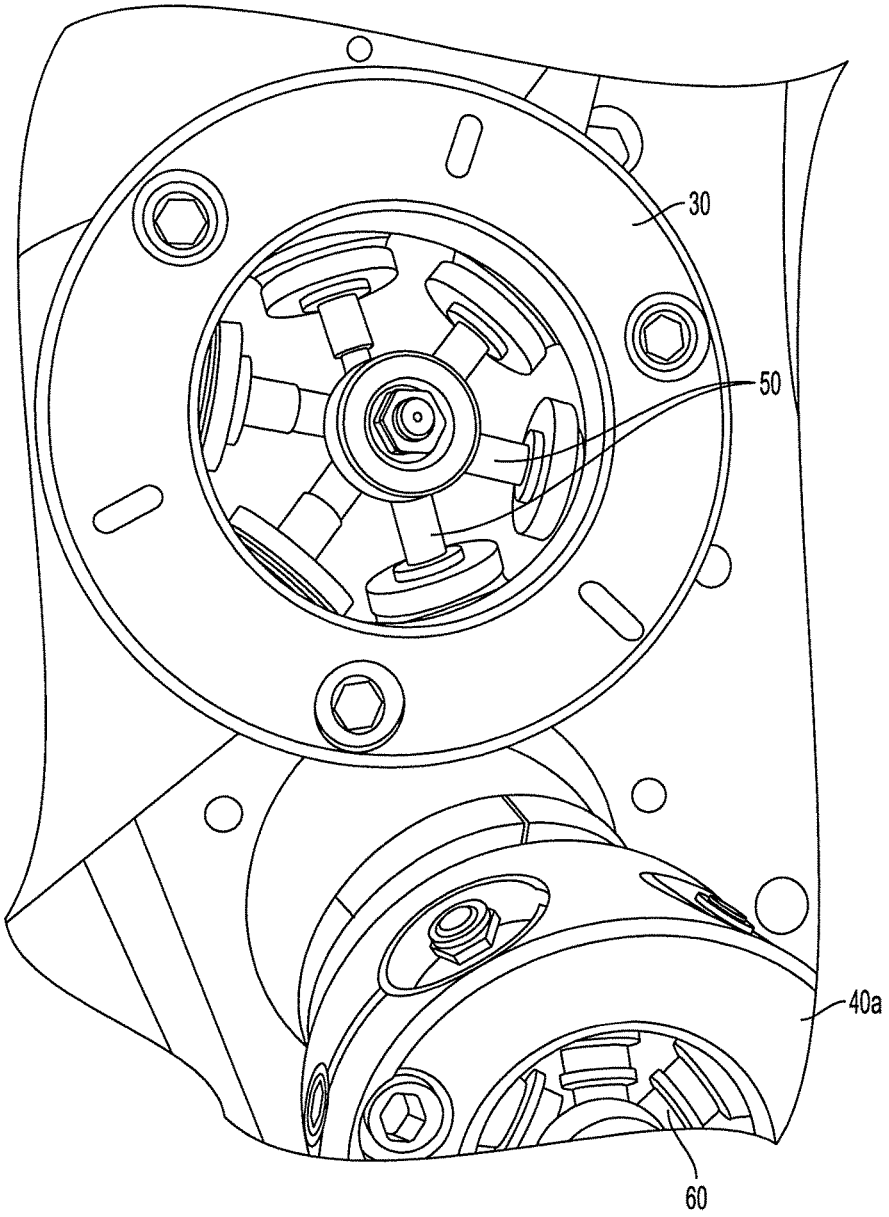
FIG. 8 is a perspective view of preferred curler roller housings and curler rollers used in a preferred method of the present disclosure for producing a preferred embodiment of a metal container or metal bottle of the present disclosure having a rolled curl fit to receive a crown closing cap.
Figure 9:
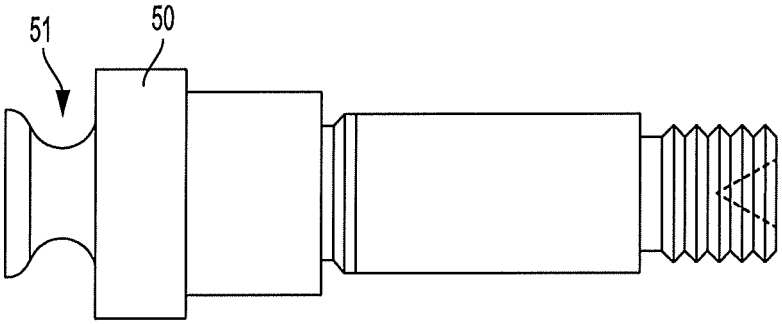
FIG. 9 is a schematic view of preferred curler roller used in a preferred method of the present disclosure for producing a preferred embodiment of a metal container or metal bottle of the present disclosure having a rolled curl fit to receive a crown closing cap.
Figure 10:
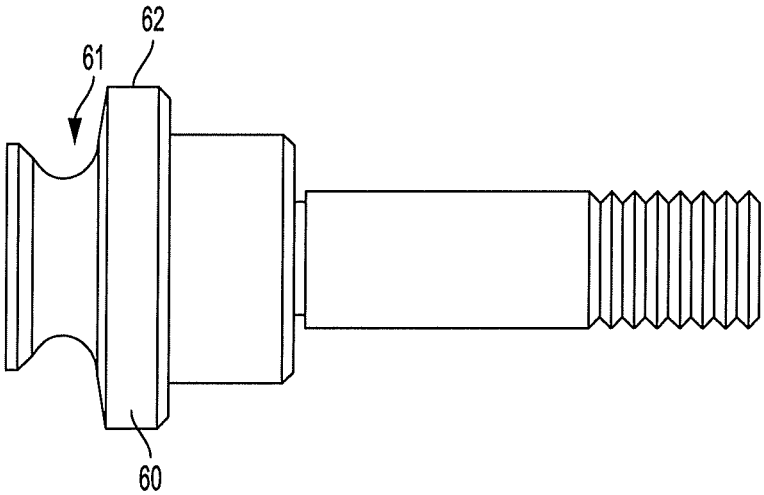
FIG. 10 is a schematic view of another preferred curler roller used in a preferred method of the present disclosure for producing a preferred embodiment of a metal container or metal bottle of the present disclosure having a rolled curl fit to receive a crown closing cap.

The apparatus to execute the process of the present disclosure includes curler roller housing 30 housing a set of six curler rollers 50 and identical curler roller housings 40*a*, 40*b* each housing a set of six curler rollers 60 as shown in FIGS. 8-9.

Construction and operation of the curler roller housings of the present disclosure is basically the same as between curler roller housing 30 and curler roller housings 40*a*, 40*b* except for the different sizes thereof and different curler rollers 50 and 60, respectively, housed thereby. Curler roller housing 30 comprises a rotating shaft, featuring a basically cylindrical section (as is known in the art), with diversified diameters and with the rear end turned, in the preferential embodiment, e.g. towards a shifting plate. This rear end of the rotating shaft is equipped with means that are already per se known which allow for quick connection and release (in case of tool replacement) of the mentioned rotating shaft with reference to the driving unit or to the movement transmission components which are located on the shifting plate of a tapering machine and which give motion to the rotating shaft itself. Rotating shaft is equipped, close to the rear end, with a ring piece, which defines a striking surface for the same rotating shaft as to a base or plate and to a body.

It is understood that curler roller housing 30, which creates the edge or collar 8*a* in a manner as described above, is similar to curler roller housings 40*a* and 40*b* that create curls 9*a* and 10*a*, respectively, in the subsequent operating stages, with the main difference that the portion 61 of the side surface of the curler rollers 60 of curler roller housings 40*a* and 40*b* is shaped differently than portion 51 of the side surface of curler rollers 50, as a function of the different pattern of desired curl 10*a*.

When side surface portion 51 or 61 of either curler roller 50 or 60, respectively, comes into contact with the upper end portion of the metal container and the mentioned upper end portion folds to form the edge or collar, as a consequence of the friction resulting from the contact between the above-mentioned side surface portion 51 or 61 of the curler roller 50 or 60, respectively, and the metal container 10, curler roller 50 or 60 starts rotating according to an axis that is perpendicular to that of the rotating shaft of the respective curler roller housing (30 or 40*a*, 40*b*).

The foregoing metal containers are deformed close to their upper end, to make the edge or collar described in this process, preferably at the final stages of the working process, that is after having undergone the multiple operating stages for the shaping of the external surface and/or the embossing/debossing operating stages, that is those processing stages that create over preset areas of the side surface shaped marks, grooves and other patterns of various shapes defined by hollow and/or embossed sectors.

Although the foregoing present disclosure has been described above with special reference made to one embodiment, which has only been provided as an example and shall not be meant to be restrictive in character, several variations and changes will be clear to anyone skilled in the art in the light of the foregoing description. Therefore, this present disclosure is meant to embrace all those modifications and variations that fall under the object and the scope of the appended claims.

We claim:

1. A method bottle comprising a cylindrical main body; a rounded shoulder disposed between the cylindrical main body and a tapered neck, wherein the tapered neck defines a first diameter where the tapered neck intersects with the rounded shoulder and a second diameter where the tapered neck intersects with a tapered upper end, wherein the first diameter is larger than the second diameter; and wherein the tapered upper end defines an opening and a rolled curl around the opening, wherein the rolled curl receives a crown closing cap and has a leading edge tucked inside of the rolled curl that is in a substantially vertical position, wherein an outside surface of the leading edge engages an outer surface of the tapered upper end of the metal bottle and wherein the rolled curl defines an outer edge having a substantially flat surface wherein an angle between a line lying in a plane of the substantially flat surface and a longitudinal centerline of the metal bottle is about 10°; wherein a portion of the rolled curl defines a curve having a radius of 1.4 mm; and wherein the rolled curl has a height of 4 mm.

* * * * *